US007887164B2

(12) United States Patent
Kuriki

(10) Patent No.: US 7,887,164 B2
(45) Date of Patent: Feb. 15, 2011

(54) LIQUID JET HEAD, A LIQUID JET APPARATUS AND A PIEZOELECTRIC ELEMENT

(75) Inventor: Akira Kuriki, Shiojiri (JP)

(73) Assignee: Seiko Epson Corporation, Shinjuku-ku, Tokyo (JP)

( * ) Notice: Subject to any disclaimer, the term of this patent is extended or adjusted under 35 U.S.C. 154(b) by 141 days.

(21) Appl. No.: 12/404,065

(22) Filed: Mar. 13, 2009

(65) Prior Publication Data

US 2009/0231397 A1 Sep. 17, 2009

(30) Foreign Application Priority Data

Mar. 13, 2008 (JP) ..... 2008-064966

(51) Int. Cl.
*B41J 2/045* (2006.01)

(52) U.S. Cl. ..... 347/71

(58) Field of Classification Search ..... 347/71, 347/68–69, 70, 72; 400/124.14, 124.16; 310/311, 324, 327
See application file for complete search history.

(56) References Cited

U.S. PATENT DOCUMENTS

2008/0074473 A1* 3/2008 Takabe et al. ..... 347/70
2008/0252697 A1* 10/2008 Kamei ..... 347/71

FOREIGN PATENT DOCUMENTS

JP 02006286925 * 10/2006
JP 2007-152912 6/2007
JP 2008-153551 7/2008

* cited by examiner

*Primary Examiner*—K. Feggins
(74) *Attorney, Agent, or Firm*—Townsend and Townsend and Crew, LLP

(57) ABSTRACT

A piezoelectric layer is formed of a plurality of ferroelectric films containing lead (Pb), zirconium (Zr), and titanium (Ti) above a first electrode. A boundary portion between a first ferroelectric film closest to the first electrode and a second ferroelectric film formed above the first ferroelectric film has an area where the maximum value of a concentration of titanium with respect to zirconium is 80% or more.

4 Claims, 11 Drawing Sheets

LIQUID JET HEAD, A LIQUID JET APPARATUS AND A PIEZOELECTRIC ELEMENT

CROSS REFERENCE TO RELATED APPLICATIONS

The entire disclosure of Japanese Patent Application No. 2008-64966, filed Mar. 13, 2008 is incorporated by reference herein.

BACKGROUND OF THE INVENTION

1. Field of the Invention

The present invention relates to a liquid jet head, a liquid jet apparatus, and a piezoelectric element.

2. Description of Related Art

As a material of a piezoelectric layer included in a piezoelectric element, a ferroelectric material containing lead (Pb), zirconium (Zr), and titanium (Ti) is used. Specifically, the piezoelectric layer formed of a plurality of ferroelectric films is formed by repeatedly performing a process of forming a piezoelectric precursor film and baking the piezoelectric precursor film plural times. At this time, a crystal seed (a crystal layer) made of titanium or titanium oxide is formed between a first ferroelectric films (a first ferroelectric film) and a second ferroelectric films (a second ferroelectric film) forming the piezoelectric layer. This piezoelectric layer is disclosed in JP-A-2007-152912, for example.

Various characteristics such as a crystalline property of this piezoelectric layer are considerably varied depending on various manufacturing conditions. In addition, when the manufacturing conditions are not appropriate, a problem may occur in that crack is caused in the piezoelectric layer upon driving the piezoelectric element. Moreover, this problem occurs not only in a piezoelectric element mounted on a liquid jet head such as an ink jet printing head but also in a piezoelectric mounted on other apparatuses.

SUMMARY OF THE INVENTION

The invention is devised in order to solve at least some of the above-mentioned problems and can be embodied as the following aspects or applied examples.

According to an aspect of the invention, there is provided a liquid jet head including: a flow passage forming substrate which is provided with a pressure generating chamber communicating to a nozzle for ejecting liquid droplets; and a piezoelectric element which includes a first electrode formed above the flow passage forming substrate, a piezoelectric layer formed above the first electrode, and a second electrode formed above the piezoelectric layer. The piezoelectric layer is formed of a plurality of ferroelectric films containing lead (Pb), zirconium (Zr), and titanium (Ti) above the first electrode. A boundary portion between a first ferroelectric film closest to the first electrode and a second ferroelectric film formed above the first ferroelectric film has an area where the maximum value of a concentration of titanium with respect to zirconium is 80% or more.

The features other than the above aspects and objects of the invention are apparent from the description of the specification with reference to the accompanying drawings.

BRIEF DESCRIPTION OF THE DRAWINGS

In order to fully understand the invention and the advantages of the invention, the following description and the accompanying drawings will be together referred.

DETAILED DESCRIPTION OF THE PREFERRED EMBODIMENTS

Figure 1:
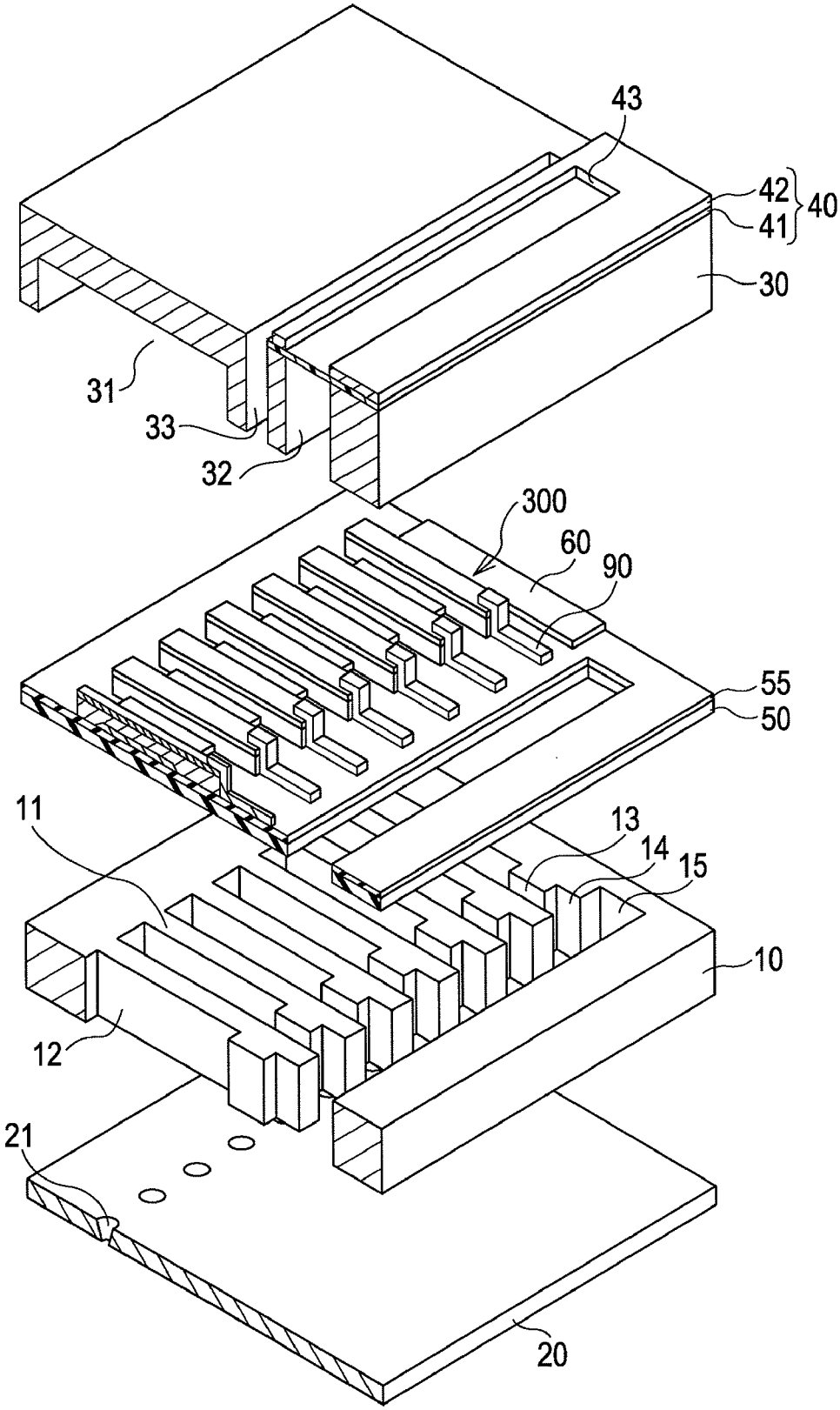
FIG. 1 is an exploded perspective view illustrating a printing head according to a first embodiment.

At least the following is apparent from the description of the specification and the description of the accompanying drawings.

According to an aspect of the invention, there is provided a liquid jet head including: a flow passage forming substrate which is provided with a pressure generating chamber communicating to a nozzle for ejecting liquid droplets; and a piezoelectric element which includes a first electrode formed above the flow passage forming substrate, a piezoelectric layer formed above the first electrode, and a second electrode formed above the piezoelectric layer. The piezoelectric layer is formed of a plurality of ferroelectric films containing lead (Pb), zirconium (Zr), and titanium (Ti) above the first electrode. A boundary portion between a first ferroelectric film closest to the first electrode and a second ferroelectric film formed above the first ferroelectric film has an area where the maximum value of a concentration of titanium with respect to zirconium is 80% or more.

With such a configuration, crack in the piezoelectric layer caused due to the drive of the piezoelectric element can be restrained from occurring. Accordingly, it is possible to improve the yield of a product. Moreover, it is possible to realize a liquid jet head improved in durability.

According to another aspect of the invention, in the liquid jet head, each of boundary portions between the ferroelectric films starting from the second ferroelectric film forming the piezoelectric layer may have an area where the maximum value of the concentration of titanium with respect to zirconium is in the range from 35 to 60%. With such a configuration, the crack in the piezoelectric layer caused due to the drive of the piezoelectric element can be restrained from occurring. Moreover, crystallization of the piezoelectric layer is improved, and thus displacement characteristics of the piezoelectric element are improved.

According to still another aspect of the invention, there is provided a liquid jet apparatus comprising a liquid jet head having the above configuration.

With such a configuration, the yield of a product is improved and the liquid jet apparatus improved in durability can be realized.

According to still another aspect of the invention, there is provided a piezoelectric element including: a first electrode; a piezoelectric layer which is formed above the first electrode; and a second electrode which is formed above the piezoelectric layer. The piezoelectric layer is formed of a plurality of ferroelectric films containing lead (Pb), zirconium (Zr), and titanium (Ti) above the first electrode. A boundary portion between a first ferroelectric film closest to the first electrode and a second ferroelectric film formed above the first ferroelectric film has an area where the maximum value of a concentration of titanium with respect to zirconium is 80% or more.

With such a configuration, the crack in the piezoelectric layer caused due to the drive of the piezoelectric element can be restrained from occurring.

Hereinafter, exemplary embodiments of the invention will be described with reference to the drawings. The embodiments described below are just described as examples of the invention and all constituent elements described below are not essential constituent elements in the invention.

PREFERRED EMBODIMENT

Hereinafter, the embodiments will be described with reference to the drawings.

First Embodiment

Figure 2:
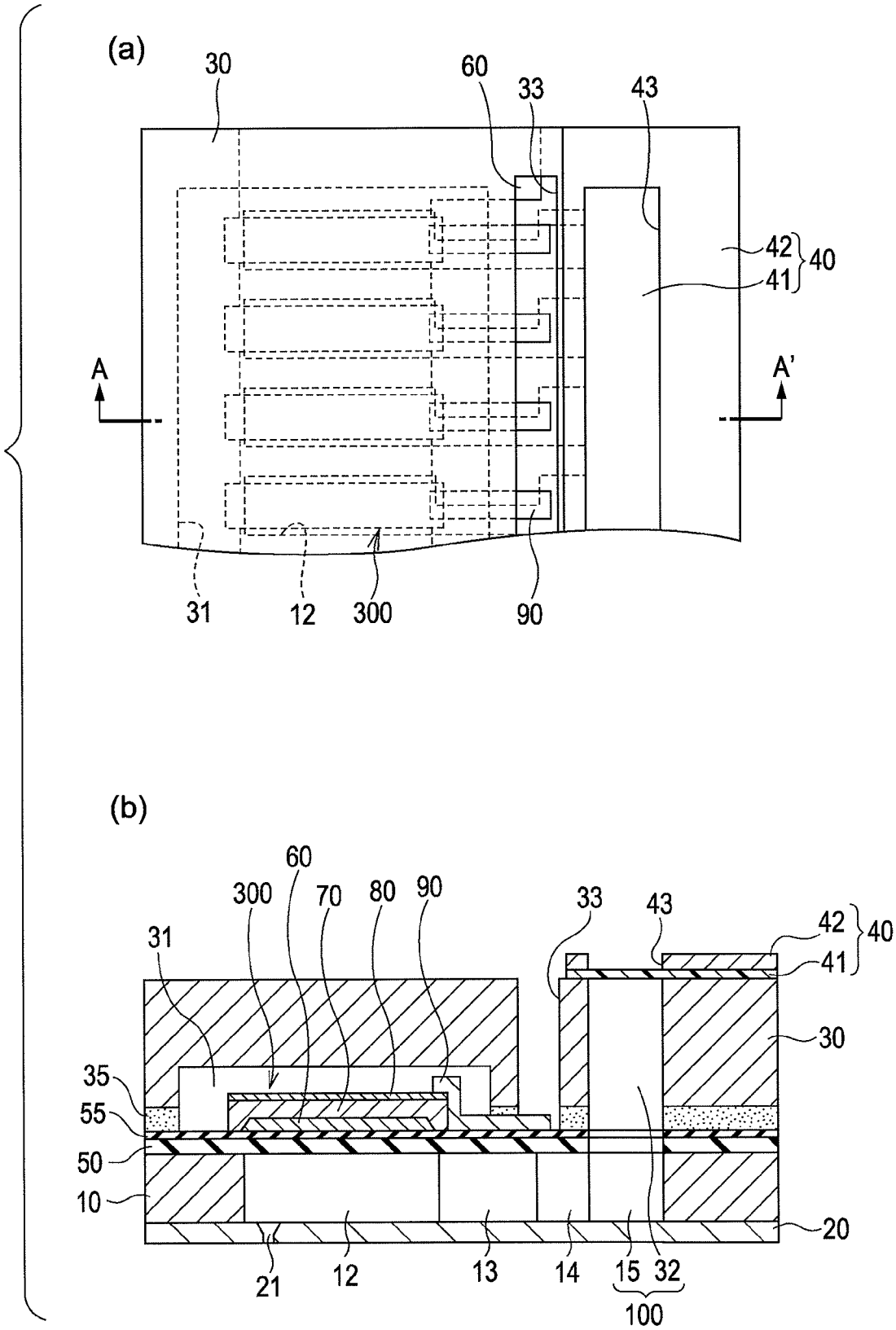
FIG. 2 is a plan view and a sectional view illustrating the printing head according to the first embodiment.
Figure 3:
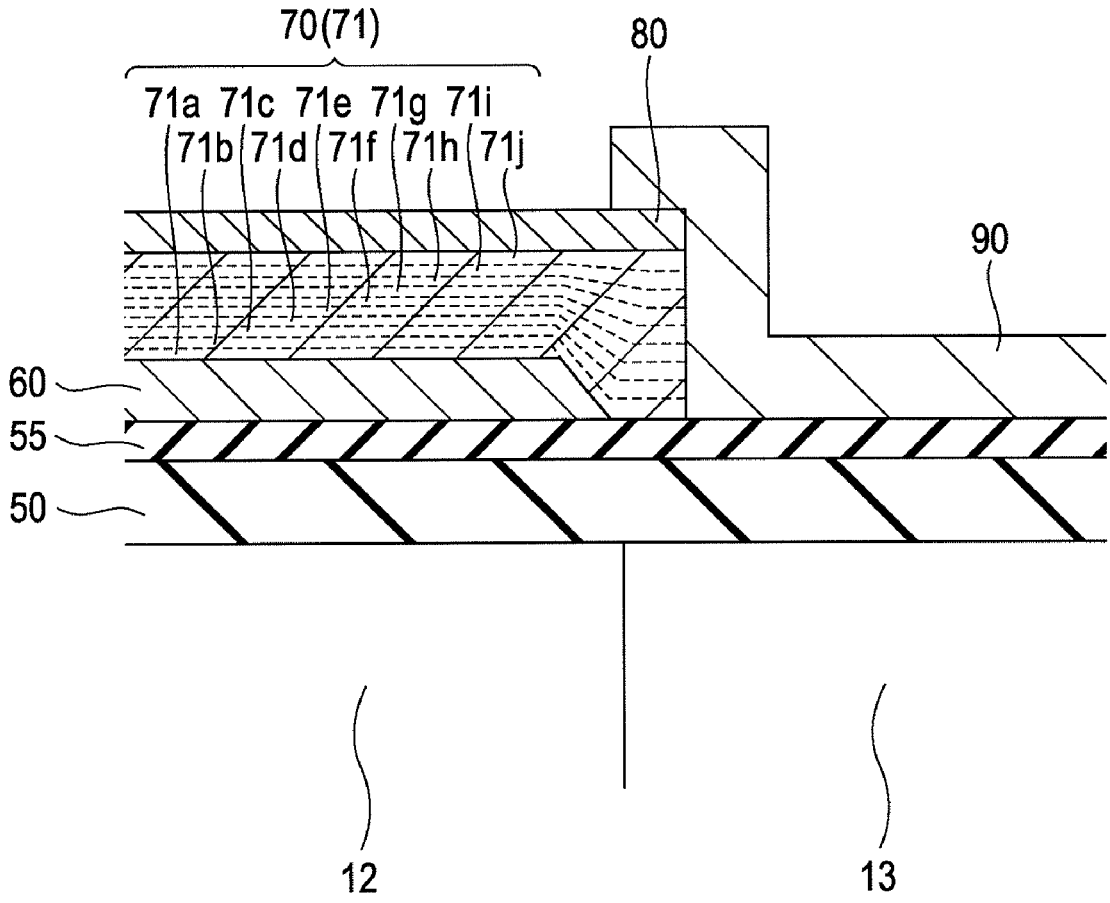
FIG. 3 is a sectional view illustrating the layer configuration of a piezoelectric element according to the first embodiment.

FIG. 1 is an exploded perspective view illustrating the general configuration of the ink jet printing head as an example of a liquid jet head manufactured by a manufacturing method according to a first embodiment of the invention. (a) of FIG. 2 is a plan view illustrating major constituent elements of the ink jet printing head and (b) of FIG. 2 is a sectional view taken along the line A-A' of (a) of FIG. 2. FIG. 3 is a sectional view illustrating the general layer configuration of a piezoelectric element.

As illustrated, a flow passage forming substrate 10 is formed of a silicon single crystal substrate having a crystal plane direction (110). An elastic film 50 formed of an oxide film is formed on one surface of the flow passage forming substrate. In the flow passage forming substrate 10, a plurality of pressure generating chambers 12 partitioned by a plurality of partition walls 11 by performing anisotropic etching from the other surface of the flow passage forming substrate 10 are arranged in parallel in the width direction (transverse direction). Ink supply passages 13 and communication passages 14 are partitioned by the partition walls 11 in one ends in a longitudinal direction of the pressure generating chambers 12 of the flow passage forming substrate 10. A communication section 15 forming a part of a reservoir 100 serving as a common ink chamber of the pressure generating chambers 12 is formed in one ends of the communication passages 14.

A nozzle plate 20 having nozzle 21 punched therethrough and individually communicating with the vicinities of the ends of the pressure generating chambers 12 opposite the ink supply passages 13 is fixed and adhered to an opening surface of the flow passage forming substrate 10 by an adhesive or a heat welding film. The nozzle plate 20 is formed of glass ceramics, a silicon single crystal substrate, stainless steel, or the like.

On the other hand, the elastic film 50 formed of the oxide film is formed opposite the opening surface of the flow passage forming substrate 10, as described above, and an insulating film 55 formed of an oxide film different from the material of the elastic film 50 is formed on the elastic film 50. Piezoelectric elements 300 each including a lower electrode film 60, a piezoelectric layer 70, and an upper electrode film 80 are formed on the insulating film 55. In general, one electrode of the pair of electrodes included in the piezoelectric element 300 serves as a common electrode common to the plurality of piezoelectric elements 300, and the other electrode independently servers as an individual electrode in each of the piezoelectric elements 300. In this embodiment, for example, the lower electrode film 60 serves as the common electrode of the piezoelectric element 300 and the upper electrode film 80 serves as the individual electrode of the piezoelectric element 300. Of course, the reverse configuration is also possible depending on the restriction condition on a driving circuit or wirings. In this embodiment, the elastic film 50, the insulating film 55, and the lower electrode film 60 serve as a vibration plate. Of course, the invention is not limited thereto. For example, only the lower electrode film 60 may serve as the vibration plate without providing the elastic film 50 and the insulating film 55. Alternatively, the piezoelectric elements 300 may practically serve as the vibration plate.

Here, the lower electrode film 60 included in the piezoelectric element 300 is patterned in the vicinities of both the ends of the pressure generating chamber 12 and is continuously formed along a direction in which the pressure generating chambers 12 are arranged in parallel. The cross-section of the lower electrode film 60 in an area corresponding to the pressure generating chamber 12 is formed as an inclined surface inclined at a predetermined angle with respect to the insulating film 55.

The piezoelectric layer 70 is independently provided in each of the pressure generating chambers 12. As shown in FIG. 3, the piezoelectric layer includes a plurality of ferroelectric films 71 (71*a* to 71*j*). A first ferroelectric film 71*a* which is the lowermost film of the plurality of films, in this embodiment, of ten ferroelectric films 71 is formed only on the lower electrode film 60. The cross-section of the first ferroelectric film is formed as a continuously inclined surface on the cross-section of the lower electrode film 60. A second ferroelectric film 71*b* to a tenth ferroelectric film 71*j* formed on the first ferroelectric film 71*a* cover the cross-section as the inclined surface to extend up to the insulating film 55.

Like the piezoelectric layer 70, the upper electrode film 80 is independently provided in each of the pressure generating chambers 12. A lead electrode 90 formed of gold (Au), for example, and extending up to the insulating film 55 is connected to each of the upper electrode films 80.

According to the invention, a boundary portion between the first ferroelectric film 71*a* forming the piezoelectric layer 70 of the piezoelectric element 300 and being closest to the lower electrode film 60 and the second ferroelectric film 71*b* formed on the first ferroelectric film has an area where the maximum value of the concentration of titanium (Ti) with respect to zirconium (Zr) is 80% or more. It is preferable that the boundary portion between the first ferroelectric film 71*a* and the second ferroelectric film 71*b* is distant in the range from 110 nm to 140 nm from the surface of the lower electrode film 60. It is preferable that in each of boundary portions between the ferroelectric films 71*b* to 71*j* starting from the second ferroelectric film, the maximum value of the concentration of Ti to Zr is in the range from 35 to 60%.

By allowing the maximum value of the concentration of Ti with respect to Zr to be equal to the above values in the boundary portions between the ferroelectric films 71*a* to 71*j* forming the piezoelectric layer 70, crack in the piezoelectric layer 70 caused due to drive of the piezoelectric element 300 can be restrained from occurring, as described below in detail.

A space ensuring that the movement of the piezoelectric elements 300 is not interrupted is provided on the flow passage forming substrate 10 provided with the piezoelectric elements 300. In addition, the space may be sealed in an airtight manner or not sealed.

A protective substrate 30 is provided with a reservoir section 32 in an area opposed to the communication section 15. The reservoir section 32 communicates with the communication section 15 of the flow passage forming substrate 10, as described above, to form a reservoir 100 serving as a common ink chamber of the pressure generating chambers 12. A through-hole 33 perforated through the protective substrate 30 in the thickness direction thereof is formed in an area between a piezoelectric element preserver 31 and the reservoir section 32 of the protective substrate 30. A part of the lower electrode film 60 and the front end portion of the lead electrode 90 are exposed to the inside of the through-hole 33.

It is preferable that the protective substrate 30 is made of a material such as glass or a ceramic material having the almost same thermal expansibility as that of the flow passage forming substrate 10. For example, the protective substrate is appropriately formed of a silicon single crystal substrate which is the same material as that of the flow passage forming substrate 10.

A compliance substrate 40 including a sealing film 41 and a fixing plate 42 is joined onto the protective substrate 30. Here, the sealing film 41 is made of a material having a low rigidity and a flexible property. One surface of the reservoir section 32 is sealed by the sealing film 41. The fixing plate 42 is made of a material such as metal having a hard property. Since an area opposite the reservoir 100 of the fixing plate 42 is formed as an opening 43 completely removed in the thickness direction, one surface of the reservoir 100 is sealed only by the sealing film 41 having a flexible property. Even though not illustrated, a driving circuit for driving the piezoelectric elements 300 is fixed onto the protective substrate 30. The driving circuit and the lead electrodes 90 are electrically connected to each other through connection wires formed of conductive wires or the like extending to the inside of the through-hole 33.

In the ink jet printing head according to this embodiment, ink is supplied from external ink supplying means (not shown), the inside from the reservoir 100 to the nozzle 21 is filled with the ink, and ink droplets are ejected from the nozzle 21 by inputting a driving signal from the upper electrode film 80 to the piezoelectric elements 300 corresponding to the pressure generating chambers 12 in accordance with a print signal supplied from the driving circuit, deforming the piezoelectric elements 300, and increasing the pressure of each of the pressure generating chambers 12.

Hereinafter, a method of manufacturing the ink jet printing head will be descried with reference to FIGS. 4 to 8. First, as shown in (a) of FIG. 4, a flow passage forming substrate wafer 110 as a silicon wafer is subjected to thermal oxidation at about 1100° C. in a diffusion furnace to form a silicon dioxide film 51 forming the elastic film 50 on the surface of the flow passage forming substrate wafer. For example, a silicon wafer having a relatively thick thickness of about 625 μm and a high rigidity property is used as the flow passage forming substrate wafer 110.

Figure 4:
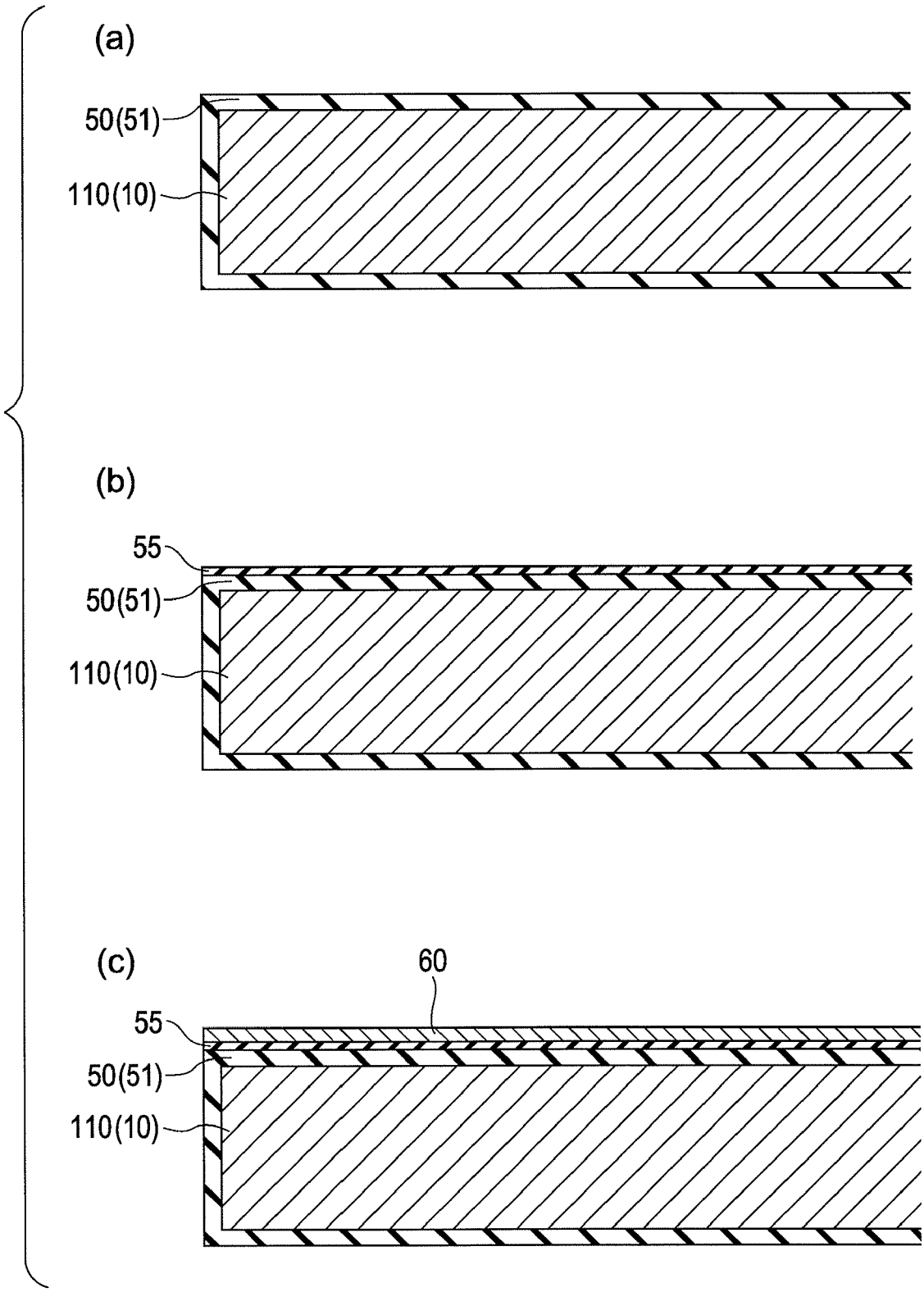
FIG. 4 is a sectional view illustrating a process of manufacturing the printing head according to the first embodiment.

Subsequently, as shown in (b) of FIG. 4, the insulating film 55 made of zirconium oxide is formed on the elastic film 50 (the silicon dioxide film 51). Specifically, a zirconium (Zr) layer is formed on the elastic film 50 (the silicon dioxide film 51) by a DC sputtering method, an RF sputtering method, or the like. The zirconium layer is subjected to thermal oxidation to form the insulating film 55 formed of zirconium oxide. Subsequently, as shown in (c) of FIG. 4, the lower electrode film 60 containing platinum and iridium, for example, is formed on the entire surface of the insulating film 55 by a sputtering method.

Subsequently, the piezoelectric layer 70 is formed on the lower electrode film 60. The piezoelectric layer 70 is formed by laminating the plurality of ferroelectric films 71*a* to 71*j*, as described above. In this embodiment, the ferroelectric films 71 are formed by a so-called sol-gel method. That is, the ferroelectric film 71 is obtained by dissolving and dispersing a metal organic substance with a solvent, applying and drying a sol, and making a gel to form the ferroelectric precursor film 72: again performing fat-removing on the ferroelectric precursor film 72 to separate organic components: and performing baking and crystallizing. Of course, the method of forming the ferroelectric film 71 is not particularly limited. For example, an MOD method may be used.

Figure 5:
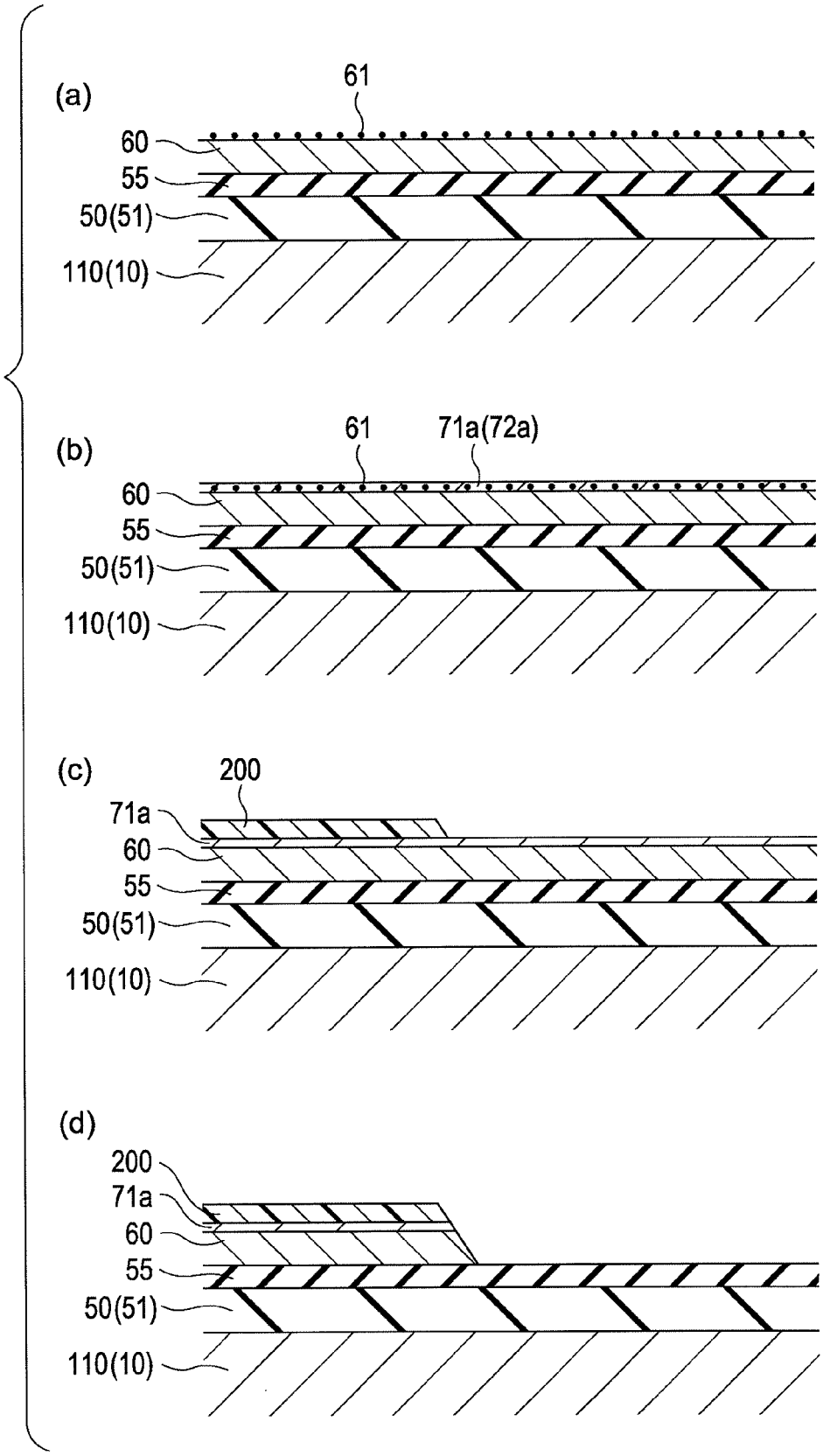
FIG. 5 is a sectional view illustrating the process of manufacturing the printing head according to the first embodiment.

Specifically, as shown in (a) of FIG. 5, a crystal seed (layer) 61 made of titanium or titanium oxide is first formed on the lower electrode film 60 by a sputtering method. Subsequently, a ferroelectric material is applied using a spin coating method, and a ferroelectric precursor film 72*a* in a non-crystal state is formed so as to have a predetermined thickness, as shown in (b) of FIG. 5. Subsequently, the ferroelectric precursor film 72*a* is dried at predetermined temperature for predetermined time to evaporate a solvent. It is desirable that the temperature for drying the ferroelectric precursor film 72*a* is in the range from 150° C. to 200° C., for example, and the temperature is preferably about 180° C. In addition, it is desirable that the time for drying the ferroelectric precursor film is in the range from 5 minutes to 15 minutes, for example, and the time is preferably about 10 minutes.

Subsequently, the dried ferroelectric precursor film 72*a* is subjected to fat-removing at predetermined temperature. Here, the fat-removing means that organic components of the ferroelectric precursor film 72*a* are separated into $NO_2$, $CO_2$, $H_2O$, and the like. It is preferable that a heating temperature of the flow passage forming substrate wafer 110 at the time of fat-removing is in the range from about 300° C. to 500° C. That is because the crystallization of the ferroelectric precursor film 72*a* starts if the temperature is too high and sufficient fat-removing cannot be performed if the temperature is too low.

In this way, after the ferroelectric precursor film 72*a* is subjected to fat-removing, the first ferroelectric film 71*a* is formed on the lower electrode film 60 by inserting the flow passage forming substrate wafer 110 into an RTA (Rapid Thermal Annealing) apparatus and baking the ferroelectric precursor film 72*a* at predetermined temperature for predetermined time to make crystallization.

After the first ferroelectric film 71*a* is formed, the lower electrode film 60 and the first ferroelectric film 71*a* are simultaneously patterned. At this time, the patterning is performed so that the cross-section of the lower electrode film 60 and the first ferroelectric film 71*a* is formed as an inclined surface inclined at a predetermined angle. Specifically, as shown in (c) of FIG. 5, a resist is applied on the first ferroelectric film 71*a*, and the resist is exposed and developed by use of a mask having a predetermined shape to form a resist film 200 having a predetermined pattern. Subsequently, as shown in (d) of FIG. 5, when the first ferroelectric film 71*a* and the lower electrode film 60 are patterned by ion milling by use of the resist film 200 as a mask, the resist film 200 is gradually etched along with the first ferroelectric film 71*a* and the lower electrode film 60. Therefore, the cross sections of the lower electrode film 60 and the first ferroelectric film 71*a* become the inclined surfaces.

Figure 6:
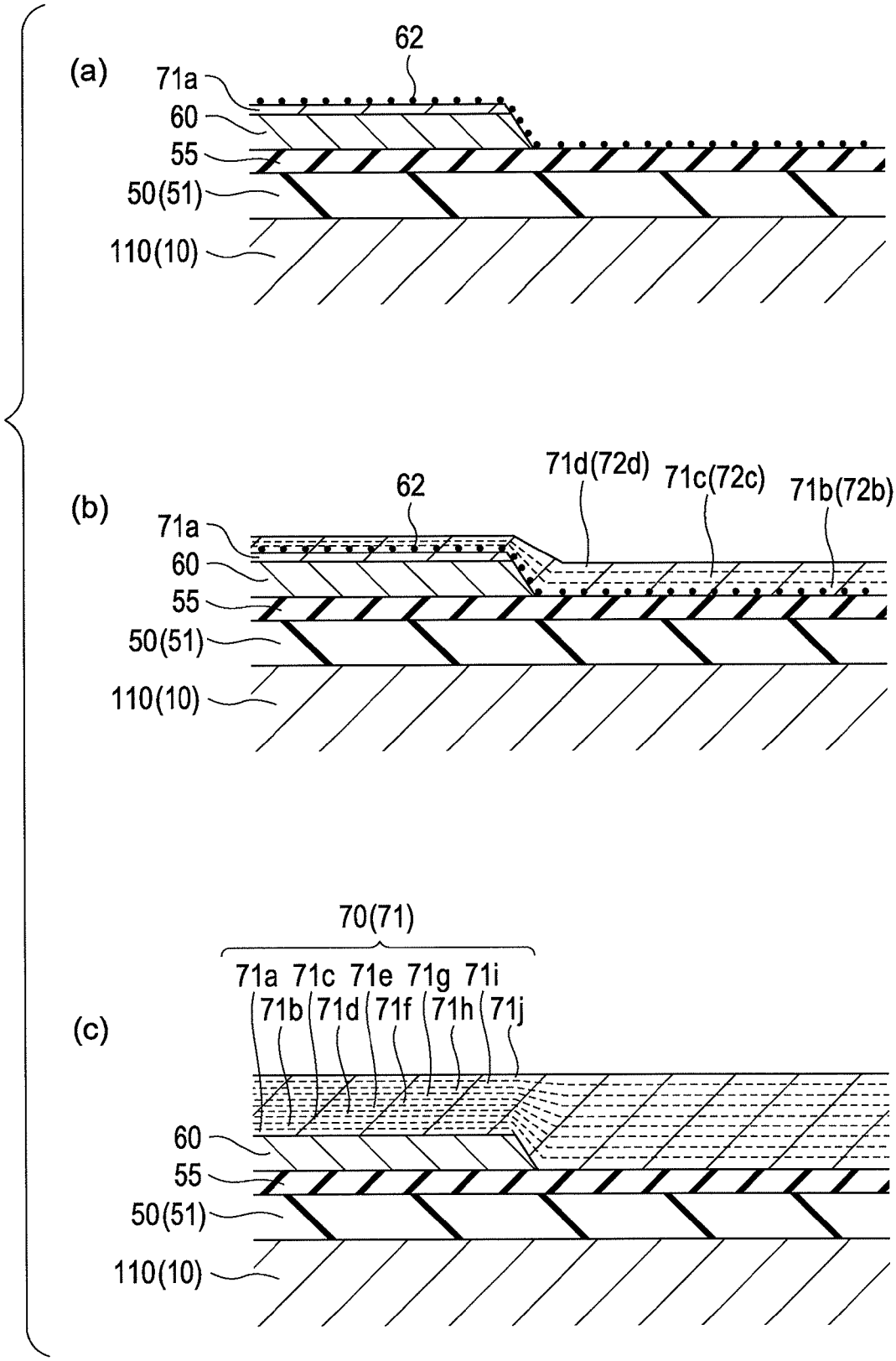
FIG. 6 is a sectional view illustrating the process of manufacturing the printing head according to the first embodiment.

Subsequently, as shown in (a) of FIG. 6, a crystal seed (layer) 62 is formed again on the entire surface of the flow passage forming substrate wafer 110 containing the first ferroelectric film 71*a*. Subsequently, as shown in (b) of FIG. 6, the piezoelectric layer 70 is formed by repeatedly performing the processes (the applying process, the drying process, and the fat-removing process) of forming the plurality of ferroelectric precursor films 72 and a process of baking the plurality of ferroelectric precursor films 72. In this embodiment, the ferroelectric precursor films 72*b* to 72*d* are formed by performing the applying process, the drying process, and the fat-removing process described above three times. Thereafter, the second ferroelectric film 71*b* to the fourth ferroelectric film 71*d* are formed by simultaneously baking the three ferroelectric precursor films 72*b* to 72*d*.

Subsequently, as shown in (c) of FIG. 6, the ferroelectric material is applied additionally on the fourth ferroelectric film 71*d* and the drying process and the fat-removing process are performed three times to form the fifth ferroelectric precursor film 72*e* to the seventh ferroelectric precursor film 72*g*. The fifth ferroelectric film 71*e* to the seventh ferroelectric film 71*g* are formed by baking the fifth ferroelectric precursor film 72*e* to the seventh ferroelectric precursor film 72*g*. The eighth ferroelectric film 71*h* to the tenth ferroelectric film 71*j* are formed on the seventh ferroelectric film 71*g* in the same manner. In this way, the piezoelectric layer 70 formed of the plurality of ferroelectric films 71*a* to 71*j* is formed. In this embodiment, the thickness of the piezoelectric layer 70 formed in this manner is about 1350 nm, for example.

According to the invention, when the piezoelectric layer 70 is formed, the maximum value (peak value) of the concentration of Ti with respect to Zr is 80% or more in a boundary portion (where the crystal layer 62 is formed) between the first ferroelectric film 71*a* and the second ferroelectric film 71*b* forming the piezoelectric layer 70. That is, by allowing titanium of the crystal layer 62 formed between the first ferroelectric film 71*a* and the second ferroelectric film 71*b* not to diffuse toward the first ferroelectric film 71*a* and the second ferroelectric film 71*b* as far as possible, the peak value of the concentration of Ti becomes 80% or more.

The concentration of Ti with respect to Zr in the boundary portion between the first ferroelectric film 71*a* and the second ferroelectric film 71*b* is varied by changing various conditions of the applying process, the drying process, the fat-removing process, and the baking process described above. That is, by appropriately changing manufacturing conditions of each process, it is possible to adjust the concentration of Ti with respect to Zr in the boundary portion between the first ferroelectric film 71*a* and the second ferroelectric film 71*b*. In particular, since a baking temperature of each ferroelectric precursor film influences on the concentration of titanium in the baking process, the concentration of titanium generally increases with an increase in the baking temperature.

By allowing the maximum value of the concentration of Ti with respect to Zr in the boundary portion between the first ferroelectric film 71*a* and the second ferroelectric film 71*b* forming the piezoelectric layer 70 to be 80% or more, it is possible to restrain the crack in the piezoelectric layer 70 caused due to the drive of the piezoelectric elements 300 from occurring. It is preferable that the boundary portion between the first ferroelectric film 71*a* and the second ferroelectric film 71*b* is distant in the range from 110 nm to 140 nm from the surface of the lower electrode film 60, thereby realizing the above-described advantage further remarkably.

As described above, it is preferable that the maximum value of the concentration of Ti with respect to Zr is in the range from 35 to 60% in the boundary portions between the ferroelectric films 71*b* to 71*j* starting from the second ferroelectric film forming the piezoelectric layer 70. That is, it is preferable that a composition ratio of the boundary portions between the second ferroelectric film 71*b* to the tenth ferroelectric film 71*j* is not varied in the manufacturing process. Accordingly, since the crystallization of the piezoelectric layer 70 is improved, the crack in the piezoelectric layer 70 can be prevented and displacement characteristics of the piezoelectric elements 300 can be also improved. The concentration of Ti with respect to Zr in the boundary portions between the second ferroelectric film 71*b* to the tenth ferroelectric film 71*j* can be adjusted by appropriately changing various manufacturing conditions.

Examples of the material of the piezoelectric layer 70 included in the piezoelectric element 300 include a ferroelectric piezoelectric material having a perovskite crystal structure or a relaxor ferroelectric formed by adding metal such as niobium, nickel, magnesium, bismuth, or yttrium to a ferroelectric piezoelectric material. The composition of the material is appropriately selected in consideration of the features and use of the piezoelectric element 300. For example, $PbTiO_3$ (PT), $PbZrO_3$ (PZ), $Pb(ZrxTi1-x)O_3$ (PZT), $Pb(Mg_{1/3}\ Nb_{2/3})O_3$—$PbTiO_3$ (PMN-PT), $Pb(Zn_{1/3}Nb_{2/3})O_3$—$PbTiO_3$ (PZN-PT), $Pb(Ni_{1/3}Nb_{2/3})O_3$—$PbTiO_3$ (PNN-PT), $Pb(In_{1/2}Nb_{1/2})O_3$—$PbTiO_3$ (PIN-PT), $Pb(Sc_{1/2}Ta_{1/2})O_3$—$PbTiO_3$ (PST-PT), $Pb(Sc_{1/2}Nb_{1/2})O_3$—$PbTiO_3$ (PSN-PT), $BiScO_3$-$PbTiO_3$ (BS-PT), $BiYbO_3$—$PbTiO_3$ (BY-PT), or the like can be used. In this embodiment, the ferroelectric films 71 forming the piezoelectric layer 70 are formed by the sol-gel method, but the invention is not limited thereto. For example, the ferroelectric films may be formed by a so-called MOD (Metal-Organic Decomposition) method of applying a colloid solution, which is obtained by dissolving an organic metal compound such as metal alkoxide with alcohol and adding a hydrolytic inhibitor or the like to the dissolved organic metal compound, to a target and drying and baking the colloid solution to form a film.

A heating apparatus used for baking the ferroelectric precursor film 72 is not particularly limited. For example, the RTA (Rapid Thermal Annealing) apparatus can be appropriately used.

Figure 7:
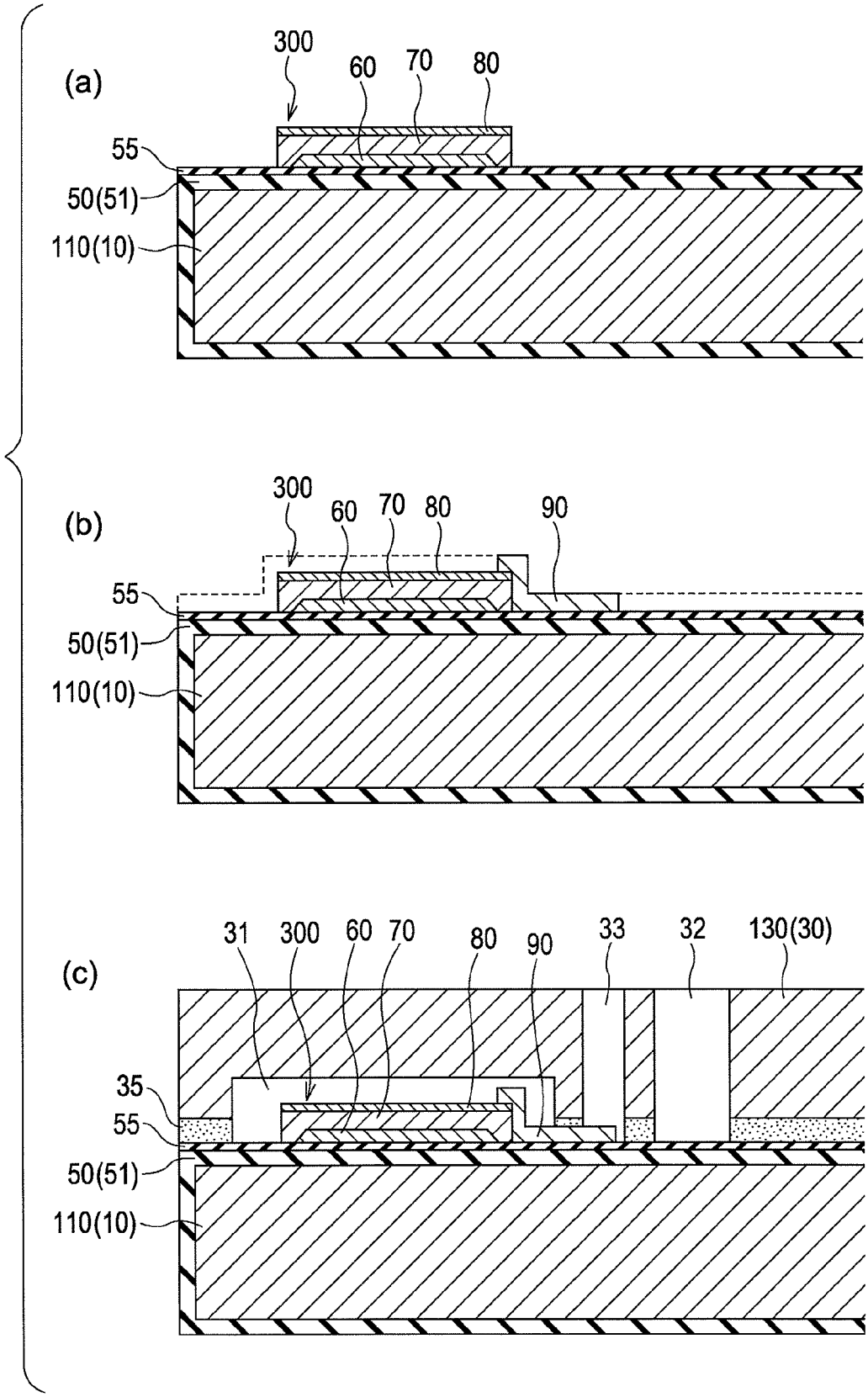
FIG. 7 is a sectional view illustrating the process of manufacturing the printing head according to the first embodiment.

After the piezoelectric layer 70 formed of the plurality of ferroelectric films 71*a* to 71*j* is formed, the upper electrode film 80 made of iridium (Ir), for example, is laminated and the piezoelectric layer 70 and the upper electrode film 80 are patterned in an area opposed to each of the pressure generating chambers 12 to form the piezoelectric element 300, as shown in (a) of FIG. 7.

After the piezoelectric element 300 is formed, a metal layer made of gold (Au) is formed on the entire surface of the flow passage forming substrate 10, and then a metal layer is patterned in each of the piezoelectric elements 300 through a mask pattern (not shown) formed of a resist, for example, as shown in (b) of FIG. 7.

Subsequently, as shown in (c) of FIG. 7, a protective substrate wafer 130 in which the plurality of protective substrates 30 are integrally formed is attached onto the flow passage forming substrate wafer 110 by an adhesive 35. In addition, a piezoelectric element preserver 31, the reservoir section 32, and the like are formed in advance in the protective substrate wafer 130. The protective substrate wafer 130 is a silicon wafer having a thickness of about 400 ∞m, for example. By joining the protective substrate wafer 130, a rigidity property of the flow passage forming substrate wafer 110 is considerably improved.

Figure 8:
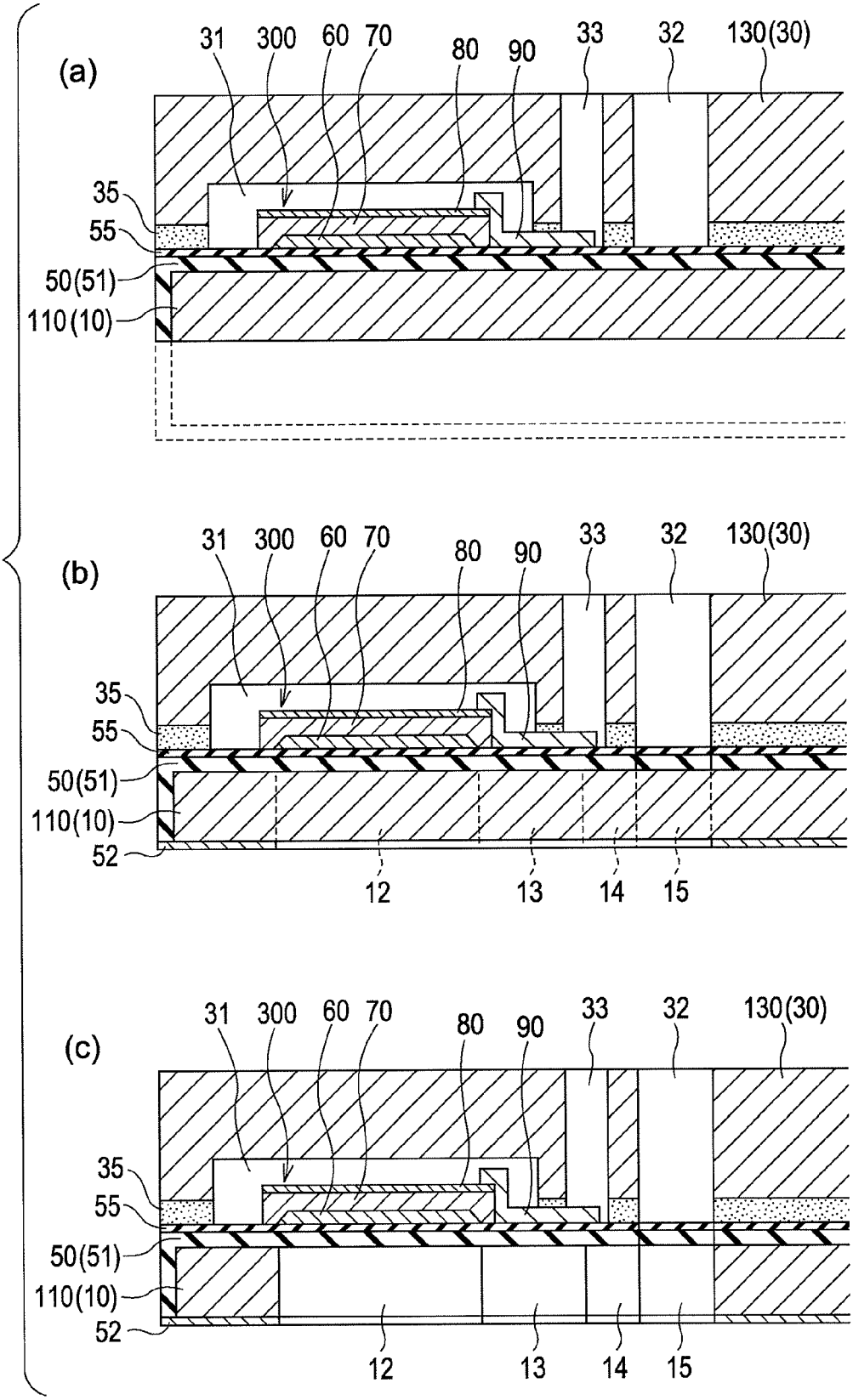
FIG. 8 is a sectional view illustrating the process of manufacturing the printing head according to the first embodiment.

Subsequently, after the flow passage forming substrate wafer 110 is formed so as to have a predetermined thickness, as shown in (a) of FIG. 8, a protective film 52 made of silicon nitride (SiN), for example, is newly formed on the flow passage forming substrate wafer 110 and patterned in a predetermined shape, as shown in (b) of FIG. 8. Subsequently, as shown in (c) of FIG. 8, the flow passage forming substrate wafer 110 is subjected to anisotropy etching (wet etching) by use of the protective film 52 as a mask to form the pressure generating chambers 12, the ink supply passages 13, and the communication passages 14, and the communication sections 15 in the flow passage forming substrate wafer 110.

Subsequently, unnecessary portions of the outer circumferences of the flow passage forming substrate wafer 110 and the protective substrate wafer 130 are cut and removed by dicing, for example. The nozzle plate 20 having the nozzle 21 punched therethrough is joined onto a surface of the flow passage forming substrate wafer 110 opposite the protective substrate wafer 130, the compliance substrate 40 is joined to the protective substrate wafer 130, and the flow passage forming substrate wafer 110 is divided into the flow passage forming substrates 10 having one chip size, as shown in FIG. 1, to manufacture the ink jet printing head having the above-described configuration.

Figure 9:
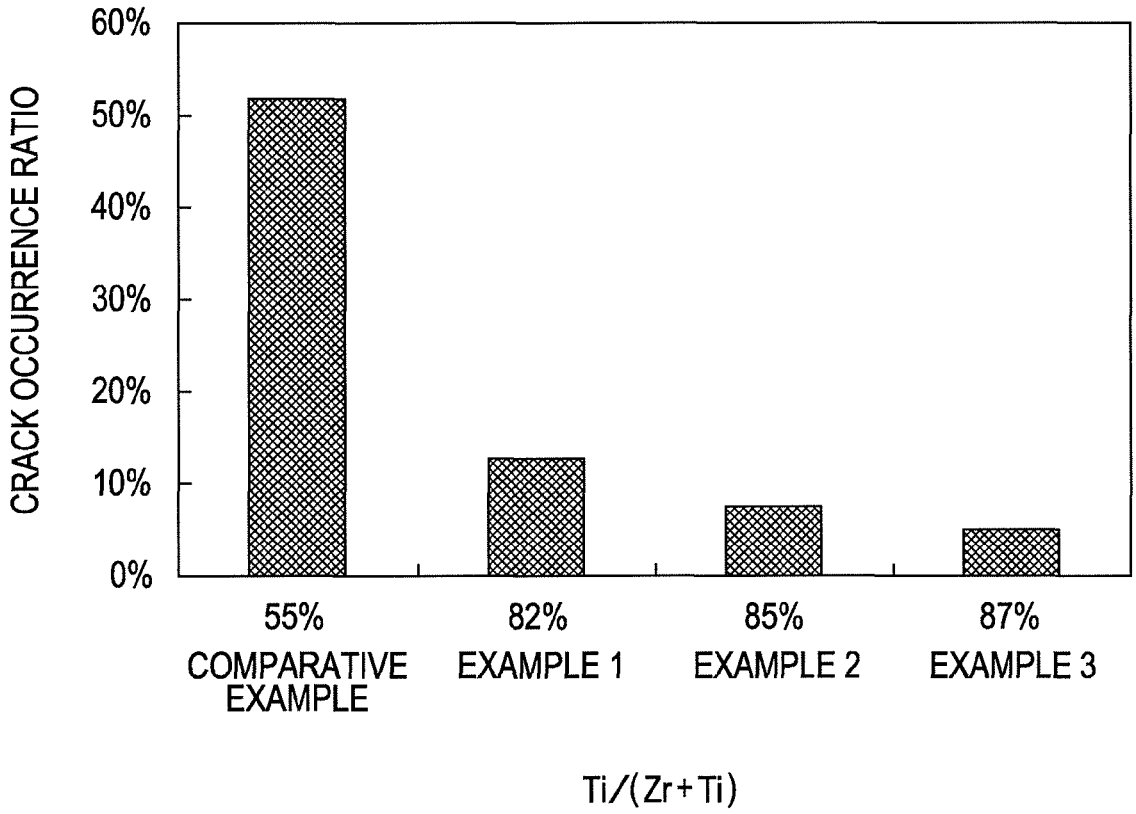
FIG. 9 is a graph illustrating a relation between the concentration of Ti with respect to Zr and a crack occurrence ratio.
Figure 10:
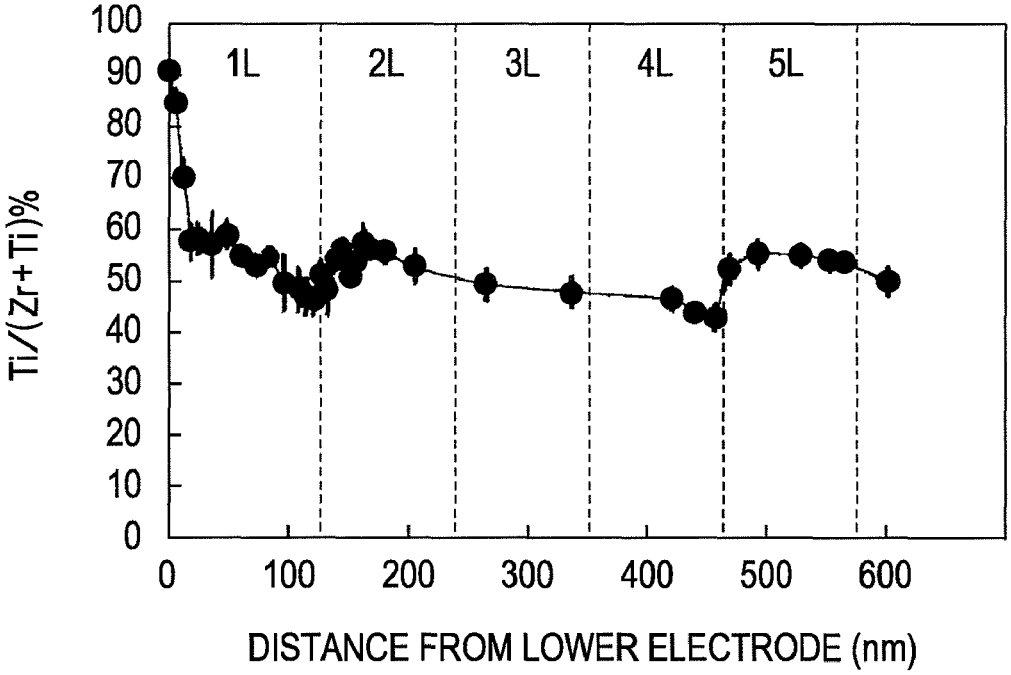
FIG. 10 is a graph illustrating the concentration of Ti with respect to Zr of a piezoelectric layer according to Comparative Example.
Figure 11:
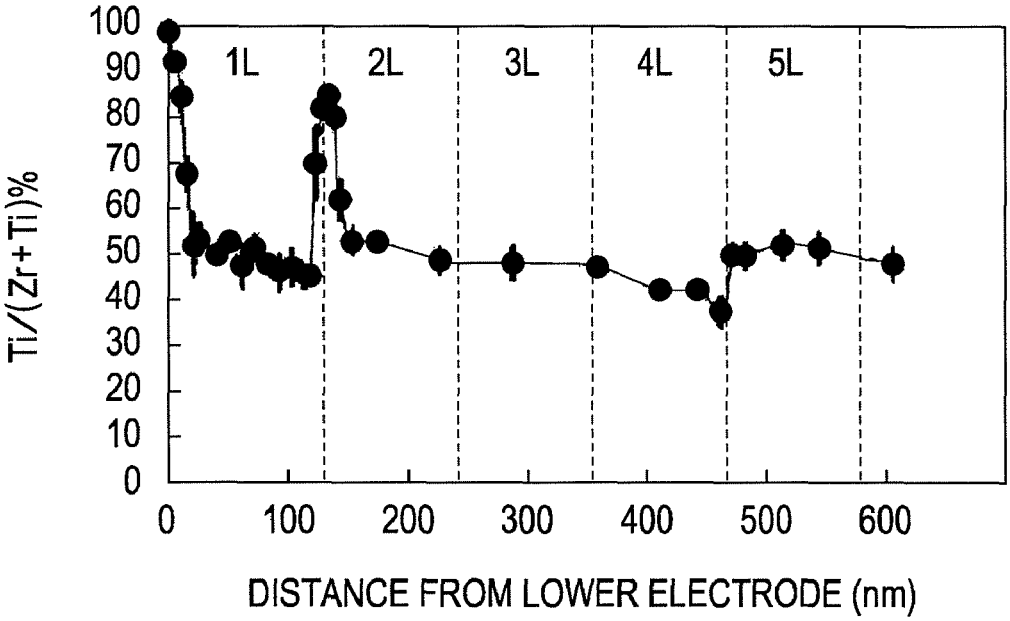
FIG. 11 is a graph illustrating the concentration of Ti with respect to Zr of a piezoelectric layer according to Example 1.

A result obtained by examining a relation between the concentration of Ti with respect to Zr in the boundary portion between the first ferroelectric film 71*a* and the second ferroelectric film 71*b* and a crack occurrence ratio of the piezoelectric layer 70 made by the drive of the piezoelectric elements 300 in the ink jet printing head manufactured in the above manner will be described. Specifically, an ink jet printing head in which the concentration of Ti with respect to Zr in the piezoelectric layer 70 included in the piezoelectric element 300 is about 55% is manufactured according to Comparative Example. In addition, a plurality of ink jet printing heads in which the concentrations of Ti with respect to Zr are about 82%, about 85%, and about 87% are manufactured according to Examples 1 to 3. After the piezoelectric elements of each ink jet printing head were driven predetermined times, a ratio of the ink jet printing heads in which crack occurs in the piezoelectric layer 70 was inspected. FIG. 9 is a graph illustrating results of the crack occurrence ratios. FIG. 10 is a graph illustrating the concentration of Ti with respect to Zr in the piezoelectric layer according to Comparative Example. FIG. 11 is a graph illustrating the concentration of Ti with respect to Zr in the piezoelectric layer according to Example 1. The graphs illustrated in FIGS. 10 and 11 show results measured by a transmission electron microscopy (TEM).

In the ink jet printing head according to Comparative Example, the maximum value (peak value) of the concentration of Ti with respect to Zr in the boundary portion between the first ferroelectric film (1L) and the second ferroelectric film (2L) forming the piezoelectric layer is in the range from 50 to 60%, as shown in FIG. 10. In the ink jet printing head according to Comparative Example, the crack occurrence ratio was about 50%, which was too high, as shown in FIG. 9.

However, in the ink jet printing head according to Example 1, the maximum value (peak value) of the concentration of Ti with respect to Zr in the boundary portion between the first ferroelectric film (1L) and the second ferroelectric film (2L) forming the piezoelectric layer is 80% or more, as shown in FIG. 11. In the ink jet printing head according to Example 1, the crack occurrence ratio was considerably decreased to about 12%, as shown in FIG. 9.

Even though graphs showing the concentrations of Ti with respect to Zr of the piezoelectric layer according to Examples 2 and 3 are not illustrated, the peak value of the concentration of Ti with respect to Zr in the boundary portion between the first ferroelectric film and the second ferroelectric film was higher than that of the ink jet printing head according to Example 1. In the ink jet printing heads according to Examples 2 and 3, the crack occurrence ratio was about 10% or less and was smaller than that of the ink jet printing head according to Example 1, as shown in FIG. 9.

As apparent from these results, the maximum value of the concentration of titanium with respect to zirconium in the boundary portion between the first ferroelectric film 71*a* and the second ferroelectric film 71*b* was 80% or more. Accordingly, it is possible to restrain the crack in the piezoelectric layer 70 caused due to the drive of the piezoelectric element 300 from occurring. Moreover, as the concentration of Ti with respect to Zr increases, it is possible to more surely restrain the crack in the piezoelectric layer 70 from occurring.

The maximum values of the concentrations of Ti with respect to Zr in the boundary portions between the ferroelectric films starting from the second ferroelectric film forming the piezoelectric layer were all in the range from 35 to 60% according to Comparative Example and Examples. It is preferable that the concentration of Ti with respect to Zr in the boundary portion between the ferroelectric films starting from the second ferroelectric film is in the above range, but this concentration is not necessarily in the range. The crack in the piezoelectric layer can be sufficiently restrained, as long as the maximum value of the concentration of Ti with respect to Zr in the boundary portion between the first ferroelectric film and the second ferroelectric film is 80% or more.

Other Embodiments

The embodiment of the invention has been described, but the invention is not limited to the above-described embodiment in the basic configuration.

Figure 12:
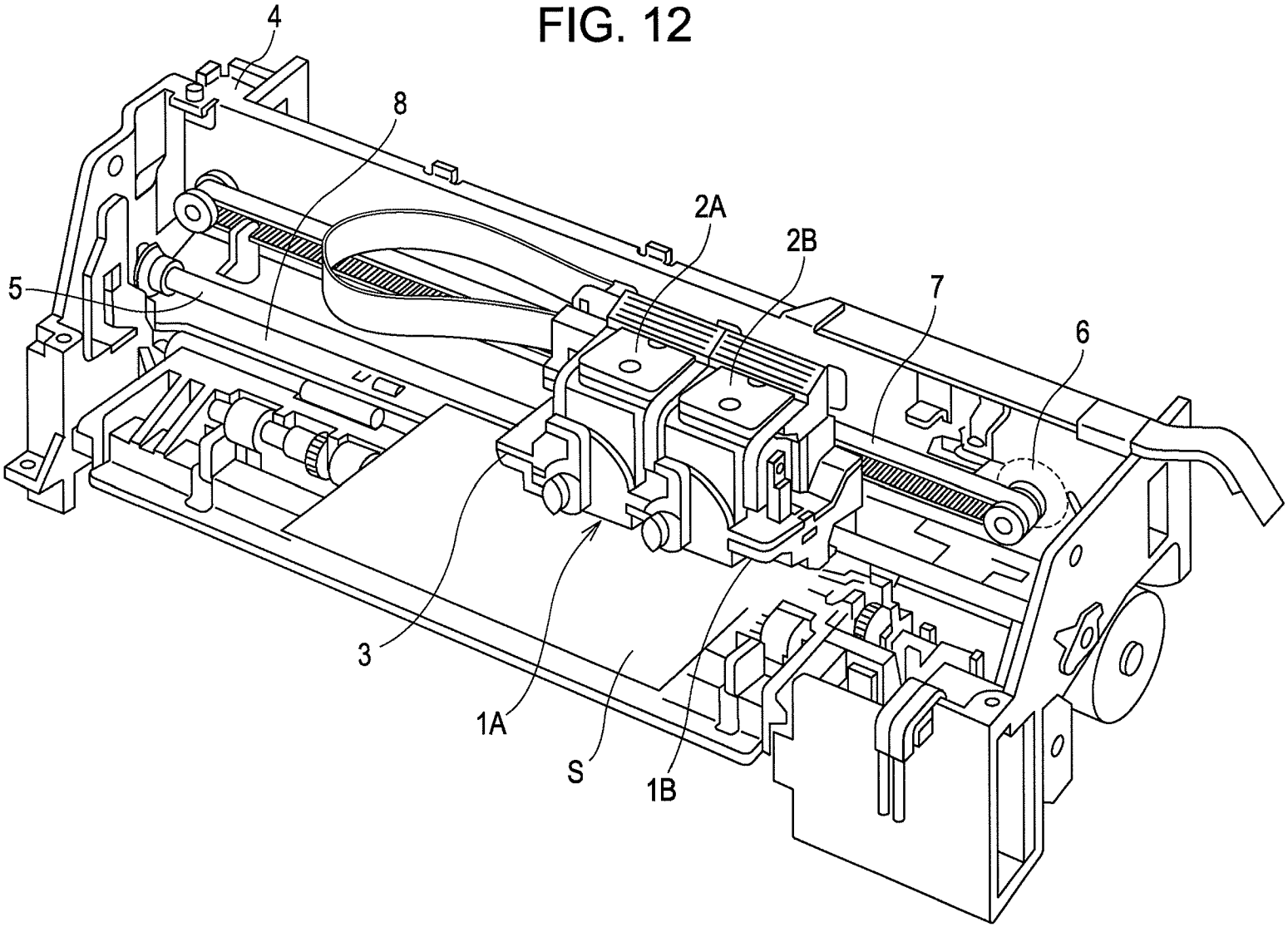
FIG. 12 is a schematic perspective view illustrating a printing head according to an embodiment of the invention.

The ink jet printing head forms a part of a printing head unit having an ink passage communicating with the ink cartridge or the like and is mounted on the ink jet printing apparatus. FIG. 12 is a schematic diagram illustrating an example of the ink jet printing apparatus. As shown in FIG. 12, printing head units 1A and 1B each having an ink jet printing head are provided so that cartridges 2A and 2B forming ink supply means are detachably mounted, respectively. A carriage 3 mounted with the printing head units 1A and 1B is provided to freely move along a carriage shaft 5 attached to an apparatus main body 4 in a shaft direction. The printing head units 1A and 1B are each configured to eject black ink and color ink, for example.

The carriage 3 mounting the printing head units 1A and 1B is moved along the carriage shaft 5 by delivering a driving force of a driving motor 6 to the carriage 3 through a plurality of toothed-gears (not shown) and a timing belt 7. On the other hand, a platen 8 is formed along the carriage shaft 5 in the apparatus main body 4. In addition, a printing sheet S as a printing medium such as a paper sheet fed by a sheet feeding roller (not shown) or the like is transported on the platen 8.

In the above-described embodiment, the ink jet printing head has been described as an example of the liquid jet head used in the liquid jet apparatus. However, the invention is devised so as to be applied to various liquid jet heads. Of course, the invention is applicable to a liquid jet head for ejecting a liquid other than ink. Examples of the liquid jet head include various printing heads used for an image printing apparatus such as a printer, a color material jet head used to manufacture a color filter such as a liquid crystal display, an electrode material jet head used to form electrodes such as an organic EL display or an FED (Field Emission Display), and a bio organism jet head used to manufacture a bio chip. In addition, the invention is applicable not only to the piezoelectric element as an actuator device used in the liquid jet head but also to other devices such as a piezoelectric element mounted in a microphone, a sounding device, various vibrators, and a transmitting device.

The invention claimed is:

1. A liquid jet head comprising:

a flow passage forming substrate which is provided with a pressure generating chamber communicating to a nozzle for ejecting liquid droplets; and a piezoelectric element which includes a first electrode formed above the flow passage forming substrate, a piezoelectric layer formed above the first electrode, and a second electrode formed above the piezoelectric layer, wherein the piezoelectric layer is formed of a plurality of ferroelectric films containing lead (Pb), zirconium (Zr), and titanium (Ti) above the first electrode, and wherein a boundary portion between a first ferroelectric film closest to the first electrode and a second ferroelectric film formed above the first ferroelectric film has an area where the maximum value of a concentration of titanium with respect to zirconium is 80% or more.

2. The liquid jet head according to claim 1, wherein each of boundary portions between the ferroelectric films starting from the second ferroelectric film forming the piezoelectric layer has an area where the maximum value of the concentration of titanium with respect to zirconium is in the range from 35 to 60%.

3. A liquid jet apparatus comprising a liquid jet head according to claim 1.

4. A piezoelectric element comprising:

a first electrode;

a piezoelectric layer which is formed above the first electrode; and a second electrode which is formed above the piezoelectric layer, wherein the piezoelectric layer is formed of a plurality of ferroelectric films containing lead (Pb), zirconium (Zr), and titanium (Ti) above the first electrode, and wherein a boundary portion between a first ferroelectric film closest to the first electrode and a second ferroelectric film formed above the first ferroelectric film has an area where the maximum value of a concentration of titanium with respect to zirconium is 80% or more.

* * * * *